US010544750B2

(12) United States Patent
Ham

(10) Patent No.: US 10,544,750 B2
(45) Date of Patent: Jan. 28, 2020

(54) CONTROL DEVICE FOR RECOGNIZING FUEL TYPE, A FUEL PUMP CONTROL SYSTEM HAVING THE SAME, AND A METHOD THEREOF

(71) Applicants: HYUNDAI MOTOR COMPANY, Seoul (KR); KIA MOTORS CORPORATION, Seoul (KR)

(72) Inventor: Chang Ho Ham, Ansan-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 150 days.

(21) Appl. No.: 15/785,937

(22) Filed: Oct. 17, 2017

(65) Prior Publication Data

US 2019/0017458 A1 Jan. 17, 2019

(30) Foreign Application Priority Data

Jul. 17, 2017 (KR) ..... 10-2017-0090326

(51) Int. Cl.
*F02D 41/30* (2006.01)
*F02D 41/22* (2006.01)

(52) U.S. Cl.
CPC .... *F02D 41/3082* (2013.01); *F02D 2041/226* (2013.01); *F02D 2200/0606* (2013.01); *F02D 2200/0611* (2013.01)

(58) Field of Classification Search
CPC ..... F02D 41/28; F02D 41/3082; F02D 2041/226; F02D 2200/0611
See application file for complete search history.

(56) References Cited

U.S. PATENT DOCUMENTS 5,163,407 A * 11/1992 Yoshida ..... F02D 35/0015 123/1 A
5,301,648 A * 4/1994 Uchinami ..... F02D 19/0628 123/1 A
5,542,394 A * 8/1996 Tomisawa ..... F02D 41/00 123/491
8,646,320 B2 * 2/2014 Sasai ..... F02D 19/084 73/114.38
2002/0134340 A1 * 9/2002 Watanabe ..... F02D 41/067 123/179.18

* cited by examiner

*Primary Examiner* — Hung Q Nguyen
*Assistant Examiner* — Mark L. Greene
(74) *Attorney, Agent, or Firm* — Lempia Summerfield Katz LLC

(57) ABSTRACT

A control device, a method, and a fuel pump control system are configured to recognize a fuel type. The control device for recognizing the fuel type includes a communication signal reception unit that receives a fuel type communication signal from a vehicle control device, a fuel type information storage unit that stores fuel type information determined at every vehicle start-up, and a fuel type determination unit that determines the fuel type by using the fuel type communication signal or the fuel type information stored in the fuel type information storage unit at and/or before the vehicle start-up.

20 Claims, 9 Drawing Sheets

<Prior Art>

<Prior Art>

| LOAD (IMEP) \ RPM | 600 | 1200 | 1800 | 2400 | 3600 | 4200 | 4800 | 5400 | 6000 |
|---|---|---|---|---|---|---|---|---|---|
| 200 | 350 | 350 | 350 | 350 | 400 | 400 | 450 | 500 | 500 |
| 400 | 350 | 350 | 350 | 350 | 400 | 400 | 450 | 500 | 500 |
| 600 | 350 | 350 | 350 | 350 | 400 | 400 | 450 | 500 | 500 |
| 800 | 350 | 350 | 350 | 350 | 400 | 400 | 450 | 500 | 500 |
| 1000 | 350 | 350 | 350 | 350 | 400 | 400 | 450 | 500 | 500 |
| 1200 | 350 | 350 | 350 | 350 | 450 | 450 | 450 | 500 | 500 |
| 1400 | 350 | 350 | 350 | 350 | 450 | 450 | 450 | 500 | 500 |
| 1600 | 350 | 350 | 350 | 350 | 450 | 450 | 450 | 500 | 500 |

FIG. 8

CONTROL DEVICE FOR RECOGNIZING FUEL TYPE, A FUEL PUMP CONTROL SYSTEM HAVING THE SAME, AND A METHOD THEREOF

CROSS-REFERENCE TO RELATED APPLICATION

This application is based on and claims the benefit of priority to Korean Patent Application No. 10-2017-0090326, filed on Jul. 17, 2017 in the Korean Intellectual Property Office, the disclosure of which is incorporated herein in its entirety by reference.

TECHNICAL FIELD

The present disclosure relates to a control device for recognizing a fuel type, a fuel pump control system having the same, and a method thereof.

BACKGROUND

In general, fuel, which is to be provided to an engine of a vehicle, flows from a fuel tank, passes through an injector, and is injected into a combustion chamber of the engine. An amount of fuel provided to the engine is determined depending on the traveling situation of the vehicle such as the traveling speed of the vehicle or the required engine torque of the engine.

The fuel tank includes a fuel pump for forming hydraulic pressure to transmit the fuel toward the engine. The fuel pump includes a motor for supplying power to create the fuel pressure.

To control the fuel pump, a fuel pump controller is provided. A conventional fuel pump controller has individual hardware for each fuel type. Accordingly, a gasoline fuel pump controller receives a target pressure from an engine to control a fuel pump through feedback. A diesel fuel pump controller receives a fuel temperature and a fuel consumption optimization (FCO) value from an engine to set a target pressure and controls a fuel pump through feedback as illustrated in FIG. 1.

In this case, the gasoline fuel pump controller and the diesel fuel pump controller have the same hardware outer appearance as illustrated in FIG. 2. In the case that two fuel types of fuel pump controllers are provided, the two fuel types of fuel pump controllers have the same hardware outer appearance and thus are mounted without distinguishing between each other after being manufactured, thereby causing high quality issues.

In addition, as the product number of the hardware of each type needs to be additionally managed, investment and part management costs may increase.

SUMMARY

The present disclosure is made to solve the above-mentioned problems occurring in the prior art while advantages achieved by the prior art are maintained intact.

An aspect of the present disclosure is to provide a control device for recognizing a fuel type, a fuel pump control system including the same, and a method thereof. According to the present disclosure, a single control device for recognizing the fuel type is provided, the fuel type is exactly recognized, and thus a fuel pump is controlled according to a fuel type. More particularly, the present disclosure is directed to a technology capable of exactly recognizing a fuel type to control a fuel pump of each fuel type.

The technical problems to be solved by the present disclosure are not limited to the aforementioned problems. Any other technical problems not mentioned herein will be clearly understood from the following description by those having ordinary skill in the art to which the present disclosure pertains.

According to an aspect of the present disclosure, a control device for recognizing a fuel type may include a communication signal reception unit that receives a fuel type communication signal from a vehicle control device. The control device may include a fuel type information storage unit that stores fuel type information determined at every vehicle start-up and a fuel type determination unit that determines the fuel type by using the fuel type communication signal or the fuel type information stored in the fuel type information storage unit at and/or before the vehicle start-up.

According to an embodiment, the fuel type determination unit may determine the fuel type by using the fuel type communication signal, if the vehicle start-up is an initial start-up.

According to an embodiment, the fuel type determination unit may determine the fuel type by comparing the fuel type communication signal with the fuel type information stored in the fuel type information storage unit, if the vehicle start-up is not an initial start-up.

According to an embodiment, the fuel type determination unit may determine the fuel type as a fuel type of the fuel type information, if the fuel type communication signal is matched with the fuel type of the fuel type information.

According to an embodiment, the fuel type determination unit may update the fuel type information to a fuel type of the fuel type communication signal and may determine the fuel type as the fuel type of the fuel type communication signal, if the fuel type of the fuel type communication signal is not matched with a fuel type of the fuel type information.

According to an embodiment, the control device may further include an error determination unit that determines whether the fuel type communication signal or the fuel type information is normal.

According to an embodiment, the fuel type determination unit may enter into a safe mode, if the fuel type communication signal or the fuel type information is invalid. The fuel type determination unit may determine the fuel type by using a target fuel pressure value or a sensed fuel temperature value instead of the fuel type communication signal.

According to an embodiment, the fuel type determination unit may determine the fuel type as a gasoline type if the target fuel pressure value is equal to or more than 1 or if the sensed fuel temperature value is absent.

According to an embodiment, the fuel type determination unit may enter into a safe mode, if the vehicle start-up is an initial start-up and if the fuel type communication signal is invalid. The fuel type determination unit may determine the fuel type by using a target fuel pressure value or a sensed fuel temperature value instead of the fuel type communication signal.

According to an embodiment, if the fuel type determination unit determines the fuel type at every vehicle start-up, the fuel type information storage unit may store the determined fuel type as the fuel type information.

According to another aspect of the present disclosure, a fuel pump control system may include a vehicle control device which outputs a communication signal for vehicle control. The fuel pump control system may include a control device for recognizing a fuel type that determines the fuel type of the vehicle by comparing the communication signal received from the vehicle control device with fuel type information stored at every vehicle start-up. The fuel pump control system may include a fuel pump control device that controls a fuel pump based on the fuel type information determined by the control device for recognizing the fuel type.

According to an embodiment, the device for recognizing the fuel type may include a communication signal reception unit that receives a fuel type communication signal from the vehicle control device. The device for recognizing the fuel type may include a fuel type information storage unit that stores the fuel type information determined at every vehicle start-up. The device for recognizing the fuel type may include a fuel type determination unit that determines the fuel type by using the fuel type communication signal or the fuel type information stored in the fuel type information storage unit at the vehicle start-up.

According to an embodiment, the fuel type determination unit may determine the fuel type as a fuel type based on the fuel type information, if the fuel type communication signal is matched with the fuel type of the fuel type information. The fuel type determination unit may update the fuel type information to a fuel type of the fuel type communication signal and may determine the fuel type as the fuel type of the fuel type communication signal, if the fuel type of the fuel type communication signal is not matched with the fuel type of the fuel type information.

According to another aspect of the present disclosure, a control method of recognizing a fuel type may include receiving a fuel type communication signal from a vehicle control device and determining a fuel type of a vehicle at a vehicle start-up by using the fuel type communication signal or fuel type information stored at every previous vehicle start-up.

According to an embodiment, the control method may further include storing the determined fuel type as the fuel type information.

According to an embodiment, the determining of the fuel type of the vehicle may include determining the fuel type by using the fuel type communication signal, if the vehicle start-up is an initial start-up. The determining of the type of fuel of the vehicle may include determining the fuel type by comparing the fuel type communication signal with the fuel type information stored in the fuel type information storage unit, if the vehicle start-up is not the initial start-up.

According to the embodiment, the determining of the fuel type of the vehicle may include determining the fuel type as a fuel type of the fuel type information, if the fuel type communication signal is matched with the fuel type of the fuel type information. The determining of the fuel of the type of the vehicle may include updating the fuel type information to a fuel type of the fuel type communication signal and determining the fuel type as the fuel type of the fuel type communication signal, if the fuel type of the fuel type communication signal is not matched with the fuel type of the fuel type information.

According to an embodiment, the control method may further include determining whether the fuel type communication signal or the fuel type information is normal.

According to an embodiment, the determining of the fuel type of the vehicle may include entering into a safe mode, if the fuel type communication signal or the fuel type information is invalid, to determine the fuel type by using a target fuel pressure value or a sensed fuel temperature value instead of the fuel type communication signal.

According to an embodiment, the determining of the fuel type of the vehicle may further include determining the fuel type as a gasoline type if the target fuel pressure value is equal to or more than 1 or the sensed fuel temperature value is absent.

BRIEF DESCRIPTION OF THE DRAWINGS

The above and other objects, features and advantages of the present disclosure will be more apparent from the following detailed description taken in conjunction with the accompanying drawings:

FIG. 8 is a table showing a target fuel pressure value, according to an embodiment of the present disclosure.

DETAILED DESCRIPTION

Figure 1:
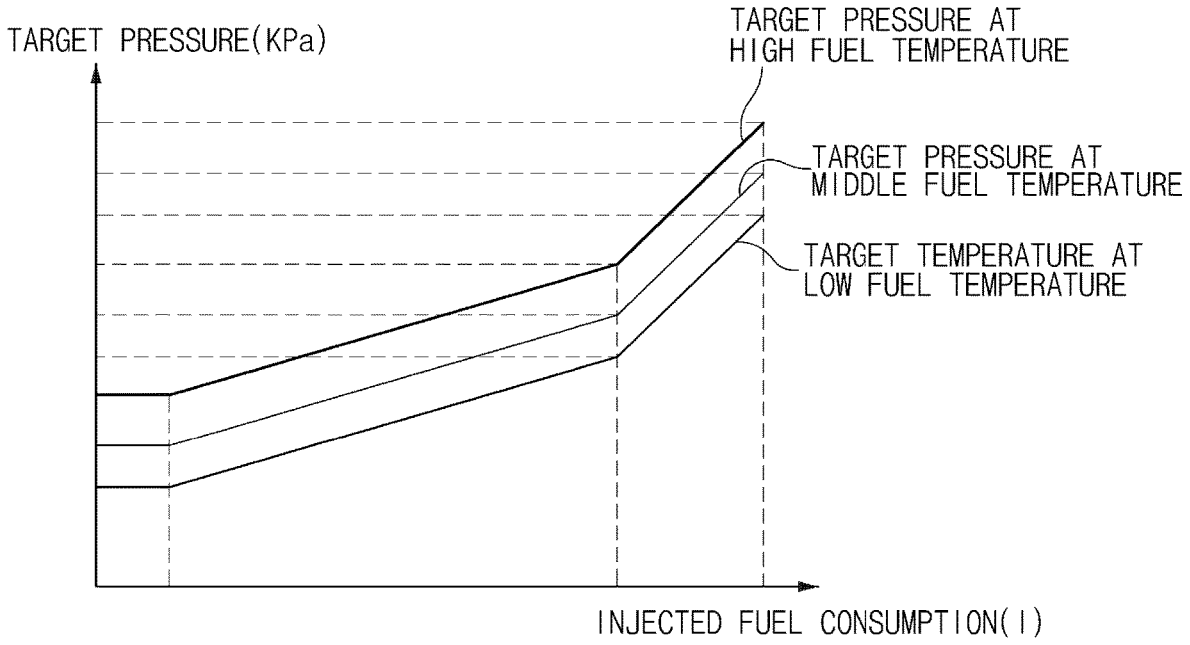
FIG. 1 is a graph illustrating logic for setting a target pressure based on an injected fuel consumption and a fuel temperature.
Figure 2:
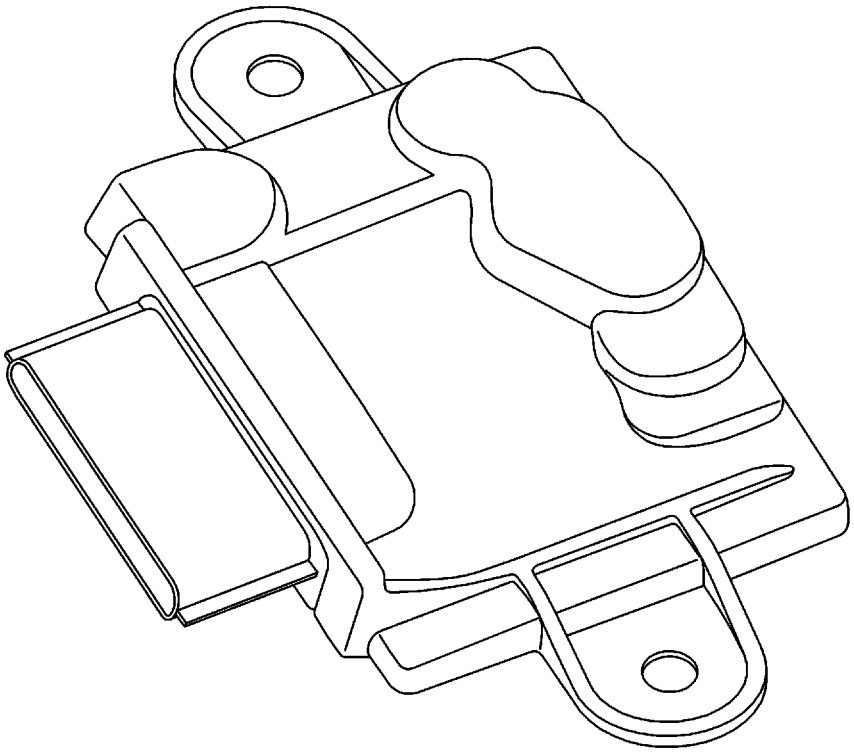
FIG. 2 is a view illustrating the configuration of the hardware of a typical control device for recognizing a fuel type.

Hereinafter, embodiments of the present disclosure are described in detail with reference to the accompanying drawings. In the drawings, the same reference numerals are used throughout to designate the same or equivalent elements. In addition, in the following description, a detailed description of well-known features or functions has been ruled out in order to avoid unnecessarily obscuring the gist of the present disclosure.

In the following description of elements according to an embodiment of the present disclosure, the terms 'first', 'second', 'A', 'B', '(a)', and '(b)' may be used. The terms are used only to distinguish relevant elements from other elements. The nature, the order, or the sequence of the relevant elements is not limited to or by the terms. In addition, unless otherwise defined, all terms used herein, including technical or scientific terms, have the same meanings as those generally understood by those having ordinary skill in the art to which the present disclosure pertains. Such terms as those defined in a generally used dictionary are to be interpreted as having meanings equal to the contextual meanings in the relevant field of art. Such terms are not to be interpreted as having ideal or excessively formal meanings unless clearly defined as having such in the present application.

Hereinafter, embodiments of the present disclosure are described in detail with reference to FIGS. 3-9.

Figure 3:
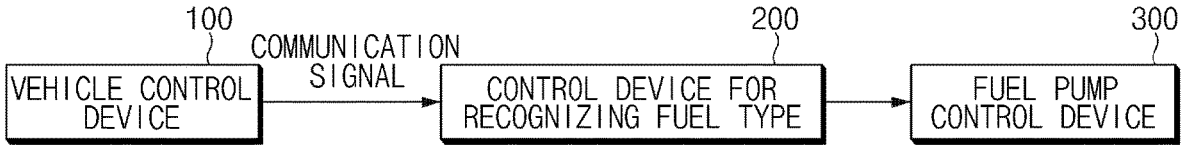
FIG. 3 is a block diagram illustrating a fuel pump control system, according to an embodiment of the present disclosure.

FIG. 3 is a block diagram illustrating a fuel pump control system, according to an embodiment of the present disclosure.

According to an embodiment of the present disclosure, the fuel pump control system determines a fuel type of a vehicle by comparing a fuel type communication signal with fuel type information stored at every vehicle start-up, thereby controlling a fuel pump depending on the determined fuel type. In this case, the fuel type communication signal is a signal received through controller area network (CAN) communication.

To this end, according to an embodiment of the present disclosure, the fuel pump control system includes a vehicle control device 100, a control device 200 for recognizing a fuel type, and a fuel pump control device 300.

The vehicle control device 100 serves as an electronic control unit (ECU) and controls all parts of a vehicle, such as a driving system, a braking system, and a steering system, in addition to an automatic transmission. According to the present disclosure, the vehicle control device 100 transmits the fuel type communication signal ("ENG_CHR"), a target fuel pressure value, and a sensed fuel temperature value to the control device 200 for recognizing the fuel type. In this case, the sensed fuel temperature value is a value sensed by a fuel temperature sensor (not illustrated) provided only in a diesel vehicle. The target fuel pressure value is zero in the case of a diesel vehicle and has an effective value in the case of a gasoline vehicle. The fuel type communication signal includes the fuel type information (gasoline or diesel).

The control device 200 for recognizing the fuel type receives the fuel type communication signal ("ENG_CHR"), the target fuel pressure value, and the sensed fuel temperature value from the vehicle control device 100 to determine the fuel type. The control device 200 transmits information on the fuel type (the fuel type information) to the fuel pump control device 300.

If the fuel pump control device 300 receives the fuel type information from the control device 200 for recognizing the fuel type, the fuel pump control device 300 controls the fuel pump depending on the fuel type.

Figure 4:
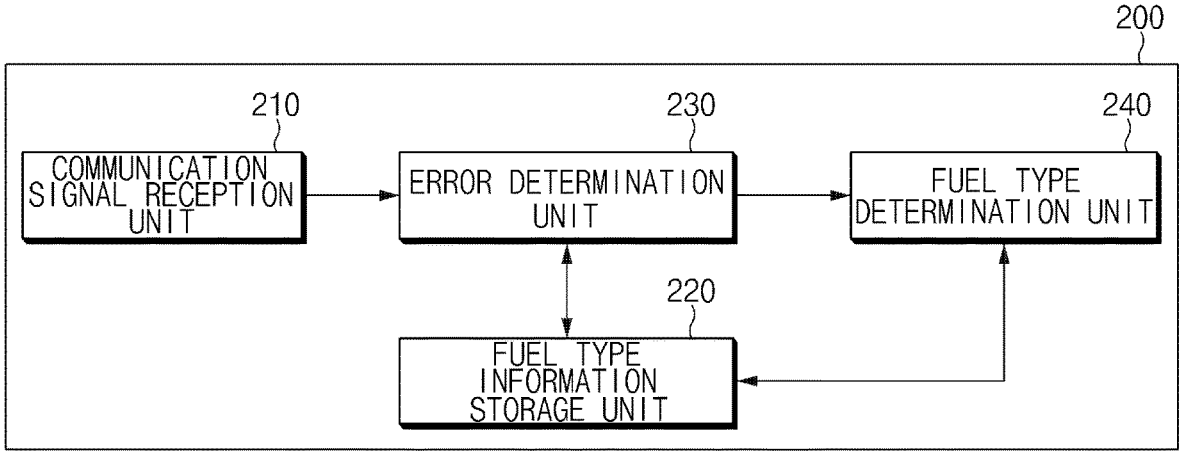
FIG. 4 is a block diagram illustrating a control device for recognizing a fuel type in detail, according to an embodiment of the present disclosure.

FIG. 4 is a block diagram illustrating the control device for recognizing the fuel type in detail, according to an embodiment of the present disclosure.

According to an embodiment of the present disclosure, the control device 200 for recognizing the fuel type includes a communication signal reception unit 210, a fuel type information storage unit 220, an error determination unit 230, and a fuel type determination unit 240.

The communication signal reception unit 210 receives the fuel type communication signal, the target fuel pressure value, and the sensed fuel temperature value from the vehicle control device 100.

The fuel type information storage unit 220 stores the fuel type information determined by the fuel type determination unit 240 at every vehicle start-up.

The error determination unit 230 determines the validity of the communication signal received from the vehicle control device 100 and the fuel type information stored in the fuel type information storage unit 220. In this case, the validity of the communication signal and the fuel type information may be determined in a typical validation manner.

The fuel type determination unit 240 determines the fuel type of the vehicle by using the communication signal received from the vehicle control device 100 and the fuel type information stored in the fuel type information storage unit 220 at the vehicle start-up.

The fuel type determination unit 240 determines the start-up state of the vehicle. If the vehicle starts up, the fuel type determination unit 240 determines whether the vehicle start-up is an initial start-up. In this case, the fuel type determination unit 240 may determine the initial start-up as a start-up, such as a first start-up for inspecting the vehicle in vehicle production or a first start-up after repairing and initialization, in the state in which the fuel type information is not stored.

The fuel type determination unit 240 determines the fuel type by using only the fuel type communication signal, if the vehicle start-up is the initial start-up. The fuel type determination unit 240 determines the fuel type by comparing the fuel type communication signal received from the vehicle control device 100 with the fuel type information stored in the fuel type information storage unit 220, if the vehicle start-up is not the initial start-up.

In addition, the fuel type determination unit 240 determines the fuel type as a fuel type based on the fuel type information, if the fuel type communication signal is matched with the fuel type of the fuel type information. For example, if the fuel type communication signal and the fuel type of the fuel type information indicate gasoline, the fuel type determination unit 240 defines the fuel type of the vehicle as gasoline.

To the contrary, the fuel type determination unit 240 updates the fuel type information to the fuel type of the fuel type communication signal and determines the fuel type as the fuel type of the fuel type communication signal, if the fuel type of the fuel type communication signal is not matched with the fuel type of the fuel type information. For example, if the fuel type communication signal indicates gasoline but the fuel type information indicates diesel, the fuel type determination unit 240 updates the fuel type information to gasoline and defines the fuel type of the vehicle as gasoline.

In addition, the fuel type determination unit 240 enters into a safe mode, if the fuel type communication signal or the fuel type information is invalid, and determines the fuel type by using the target fuel pressure value or the sensed fuel temperature value instead of the fuel type communication signal. For example, the fuel type determination unit 240 may determine the fuel type as gasoline if the target fuel pressure value is equal to or more than 1 or the sensed fuel temperature value is absent. In this case, the target fuel pressure value refers to a target fuel pressure value for controlling a fuel pump.

However, if the vehicle start-up is the initial start-up, the fuel type determination unit 240 enters into the safe mode by considering the validity of the fuel type communication signal. In this case, the initial start-up may include the first start-up for inspecting the vehicle in vehicle production or the first start-up after repairing and initialization. In other words, the initial start-up may be determined as an initial start-up in the state that the fuel type information is not stored.

As described above, according to the present disclosure, the control device 200 for recognizing the fuel type is configured in a single hardware and is mounted and applied regardless of the type of a vehicle, such as a diesel vehicle or a gasoline vehicle, thereby reducing management and production costs.

In addition, according to the present disclosure, the control device 200 for recognizing the fuel type determines the validity of the communication signal or the fuel type information previously stored. If the communication signal or the previously stored fuel type information is invalid, the control device 200 for recognizing the fuel type determines the fuel type by using another communication signal (the target fuel pressure value or the sensed fuel temperature value). Accordingly, the control device 200 for recognizing the fuel type may stably and exactly determine the fuel type and use the fuel type to control the fuel pump, thereby stably controlling the fuel pump of the vehicle.

Figure 5:
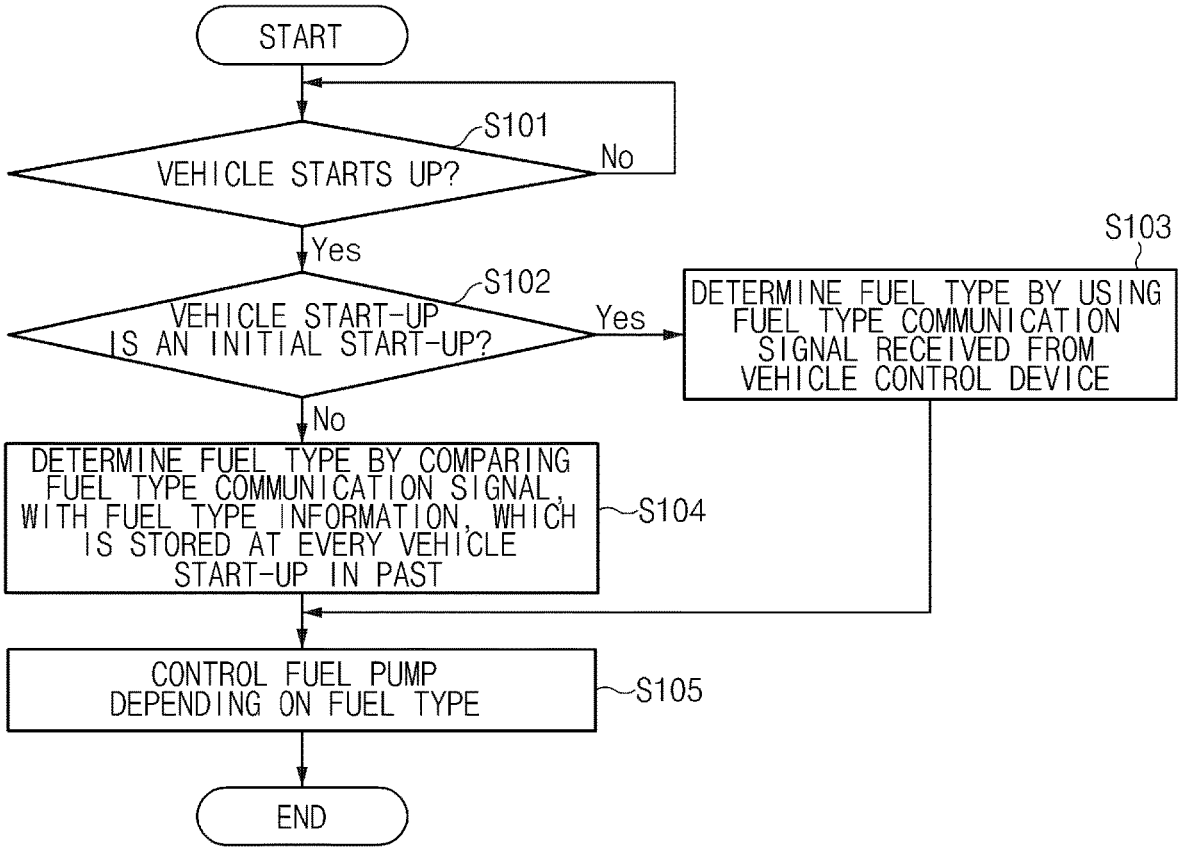
FIG. 5 is a flowchart illustrating a control method of recognizing a fuel type, according to an embodiment of the present disclosure.

Hereinafter, a control method of recognizing a fuel type according to an embodiment of the present disclosure is described with reference to FIGS. 3 and 5.

According to an embodiment of the present disclosure, the control device 200 for recognizing the fuel type determines whether a vehicle starts up (S101). If the vehicle starts up, the control device 200 for recognizing the fuel type determines whether the start-up is an initial start-up (S102).

Accordingly, if the start-up is the initial start-up, the control device 200 for recognizing the fuel type determines the fuel type by using the fuel type communication signal received from the vehicle control device 100 (S103).

If the start-up is not the initial start-up, the control device 200 for recognizing the fuel type determines the fuel type by comparing the fuel type communication signal received from the vehicle control device 100 with the fuel type information stored at every vehicle start-up in the past, i.e., the previously stored fuel type information (S104).

Thereafter, the fuel pump control device 300 controls the fuel pump depending on the determined fuel type (S105).

Figure 6:
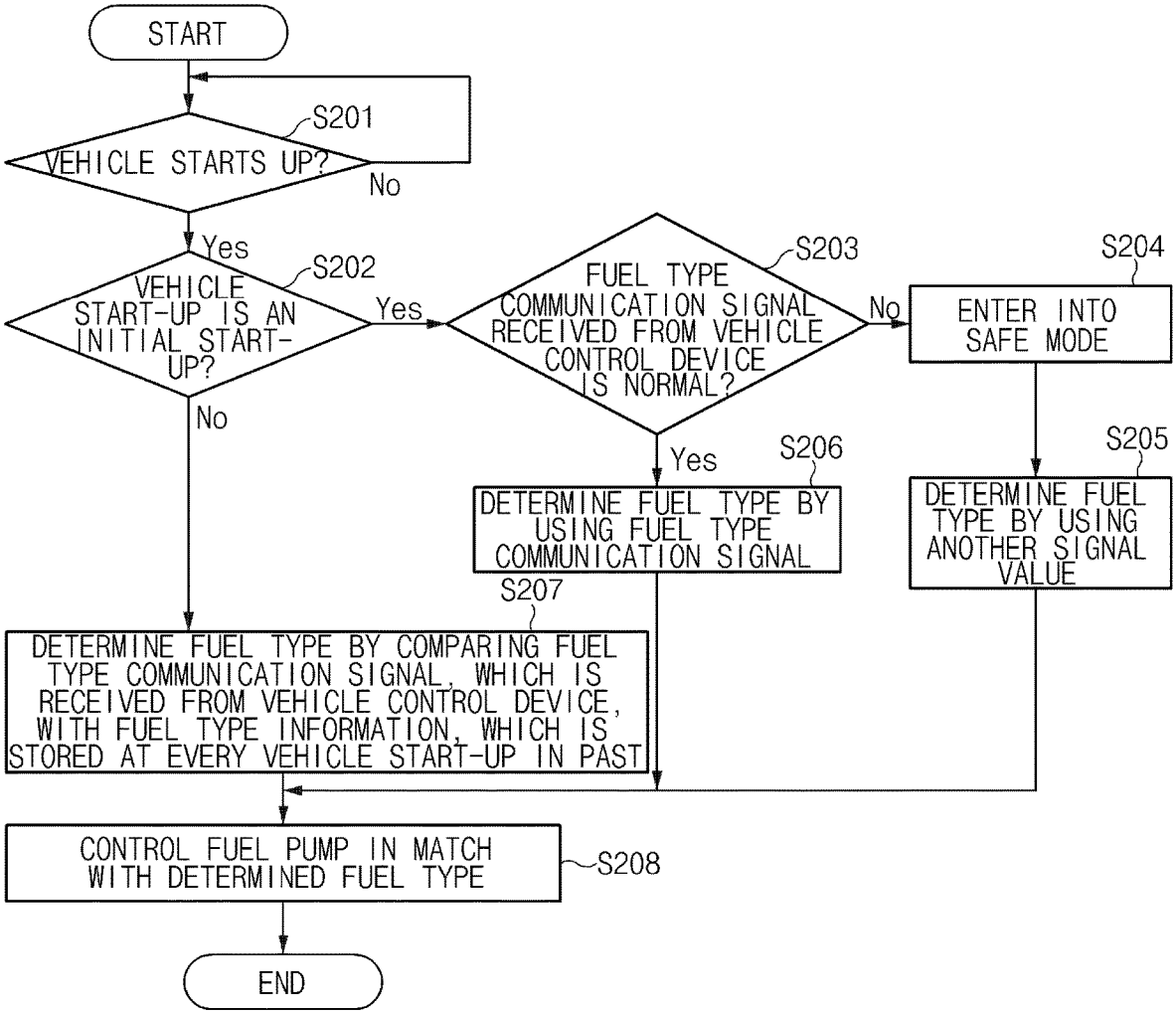
FIG. 6 is a flowchart illustrating a control method of recognizing a fuel type, according to another embodiment of the present disclosure.

Hereinafter, a control method of recognizing a fuel type according to another embodiment of the present disclosure is described below with reference to FIGS. 3 and 6.

According to an embodiment of the present disclosure, the control device 200 for recognizing the fuel type determines whether a vehicle starts up (S201). After the vehicle starts up, the control device 200 for recognizing the fuel type determines whether the start-up is an initial start-up (S202).

Accordingly, if the start-up is the initial start-up, the control device 200 for recognizing the fuel type determines whether a fuel type communication signal received from the vehicle control device 100 is normal (S203).

If the fuel type communication signal is in an error state, in other words, if the fuel type communication signal is abnormal, the control device 200 enters a safe mode for determining the fuel type (S204).

Accordingly, the control device 200 for recognizing the fuel type determines the fuel type by receiving another communication signal, such as a target fuel pressure value or a sensed fuel temperature value, instead of the fuel type communication signal from the vehicle control device 100 (S205).

To the contrary, if the fuel type communication signal is normal, the control device 200 for recognizing the fuel type determines the fuel type by using the fuel type communication signal (S206). Accordingly, the fuel pump control device 300 controls the fuel pump depending on the fuel type determined in operation S206 (S208).

If it is determined that the vehicle start-up is not the initial start-up in operation S202, the control device 200 for recognizing the fuel type determines the fuel type by comparing the fuel type communication signal received from the vehicle control device 100 with the fuel type information stored at every vehicle start-up in the past, i.e., the previously stored fuel type information (S207).

Accordingly, the fuel pump control device 300 controls the fuel pump depending on the fuel type determined in operation S207 (S208).

Hereinafter, a control method of recognizing a fuel type according to another embodiment of the present disclosure will be described in more detail with reference to FIGS. 3 and 7.

According to an embodiment of the present disclosure, if a vehicle starts up (S301), the control device 200 for recognizing the fuel type determines a fuel type value ("F_TYPE") (S302) and receives a fuel type communication signal ("ENG_CHR") from the vehicle control device 100 (ECU) (S303).

Thereafter, the control device 200 for recognizing the fuel type determines whether the fuel type communication signal ("ENG_CHR") indicates gasoline (S304). If the fuel type communication signal ("ENG_CHR") indicates gasoline, the control device 200 for recognizing the fuel type determines whether the previously stored fuel type value ("F_TYPE") is "GASOLINE" (S305).

If the previously stored fuel type value ("F_TYPE") is "GASOLINE", the control device 200 for recognizing the fuel type defines the previously stored fuel type value ("F_TYPE") as "GASOLINE" and executes logic corresponding to a gasoline type, which is the fuel type, to control a fuel pump (S307).

Meanwhile, if the previously stored fuel type value ("F_TYPE") does not indicate gasoline in operation S305, the control device 200 for recognizing the fuel type stores the fuel type value ("F_TYPE") again as "GASOLINE" (S306). Then, the control device 200 for recognizing the fuel type defines the previously stored fuel type value ("F_TYPE") as "GASOLINE" and executes the logic corresponding to the gasoline type, which is the fuel type, to control the fuel pump (S307).

If the fuel type communication signal ("ENG_CHR") is not "GASOLINE" in operation S304, the control device 200 for recognizing the fuel type determines whether the fuel type communication signal ("ENG_CHR") indicates diesel (S308). If the fuel type communication signal ("ENG_CHR") indicates diesel, the control device 200 for recognizing the fuel type determines whether the previously stored fuel type value ("F_TYPE") is "DIESEL" (S309).

If the previously stored fuel type value ("F_TYPE") is "DIESEL", the control device 200 for recognizing the fuel type defines the previously stored fuel type value ("F_TYPE") as "DIESEL" and executes logic corresponding to a diesel type, which is the fuel type, to control the fuel pump (S307).

If the previously stored fuel type value ("F_TYPE") is not "DIESEL" in operation S309, the control device 200 for recognizing the fuel type stores the fuel type value ("F_TYPE") again as "DIESEL" (S310). Then, the control device 200 for recognizing the fuel type defines the previously stored fuel type value ("F_TYPE") as "DIESEL" and executes the logic corresponding to the diesel type, which is the fuel type, to control the fuel pump (S307).

However, if it is determined that the fuel type communication signal ("ENG_CHR") is not "DIESEL" in operation S308, the control device 200 for recognizing the fuel type determines whether the previously stored fuel type value ("F_TYPE") is a valid value (S311). If the previously stored fuel type value ("F_TYPE") is the valid value, the control device 200 for recognizing the fuel type defines the previously stored fuel type value ("F_TYPE") and executes logic corresponding to the fuel type (S307).

If it is determined that the previously stored fuel type value ("F_TYPE") is not the valid value in operation S311, the control device 200 for recognizing the fuel type enters the safe mode to receive a target fuel pressure value from the vehicle control device 100 (ECU) (S312) and to determine whether the target fuel pressure value is maintained to be 1.0 bar or more for one second or more (S313).

If the target fuel pressure value is maintained to be 1.0 bar or more for one second or more, the control device 200 for recognizing the fuel type determines whether the fuel type is gasoline and stores the fuel type value ("F_TYPE") as "GASOLINE" (S315). Then, the control device 200 for recognizing the fuel type defines the previously stored fuel type value ("F_TYPE") as "GASOLINE" and executes the logic of the gasoline type to control the fuel pump (S307). In this case, the diesel vehicle has a target fuel pressure value of zero and the gasoline vehicle has a target fuel pressure value representing a specific level or more based on an RPM and a load as shown in the table of FIG. 8. FIG. 8 is a table showing the target fuel pressure value, according to an embodiment of the present disclosure. Accordingly, the target fuel pressure value of zero may be determined as indicating the diesel vehicle and the target fuel pressure value of '1' or more may be determined as indicating the gasoline vehicle.

Meanwhile, if the target fuel pressure value is maintained to less than 1.0 bar for one second or more, the control device 200 for recognizing the fuel type determines the fuel type as indicating diesel and stores the fuel type value ("F_TYPE"), again as "DIESEL" (S314). Then, the control device 200 for recognizing the fuel type defines the previously stored fuel type value ("F_TYPE") as "DIESEL" and executes the logic of the diesel type corresponding to the fuel type to control the fuel pump (S307).

Figure 7:
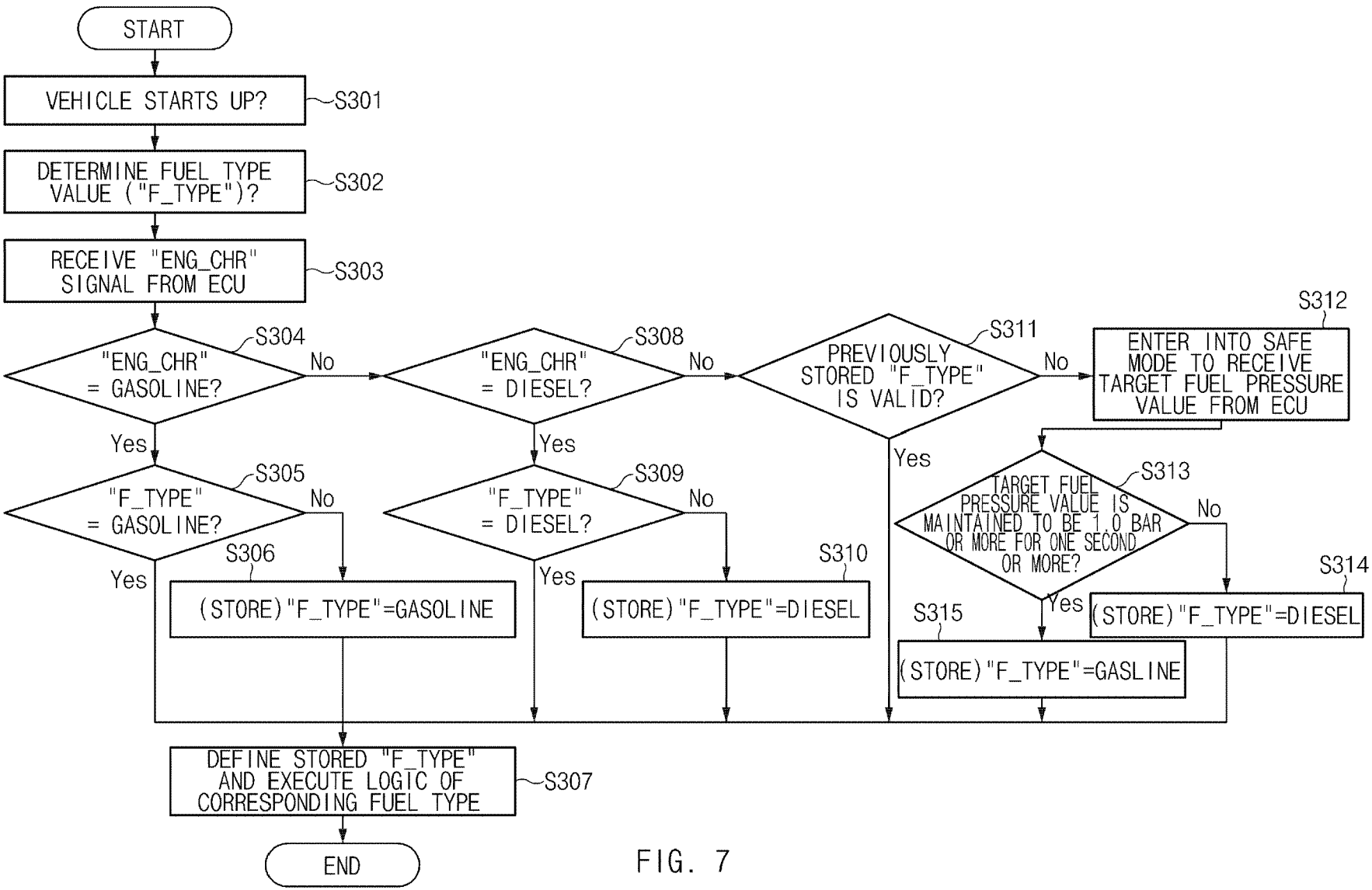
FIG. 7 is a flowchart illustrating a control method of recognizing a fuel type, according to another embodiment of the present disclosure.

In this case, although FIG. 7 illustrates a way of determining the fuel type based on the target fuel pressure value in safe-mode driving, the present disclosure is not limited thereto. For example, the fuel type may be determined based on the sensed fuel temperature value.

In other words, although the diesel vehicle is equipped with a sensor for sensing a fuel temperature, the gasoline vehicle is not equipped with the fuel temperature sensor. Accordingly, if the sensed fuel temperature value is present, a relevant vehicle may be determined as the diesel vehicle.

As described above, according to the present disclosure, only a single control device for recognizing a fuel type is provided and exactly recognizes the fuel type, thereby controlling the fuel pump according to the fuel type. Therefore, according to the present disclosure, the control device for recognizing the fuel type is applicable to various vehicles without distinguishing between fuel types.

In addition, according to the present disclosure, the control device for recognizing the fuel type recognizes the fuel type by using a communication signal received from vehicle control device. In this case, even if errors occur in the communication signal, the control device for recognizing the fuel type may be driven in a safe mode to stably and exactly recognize the fuel type.

Figure 9:
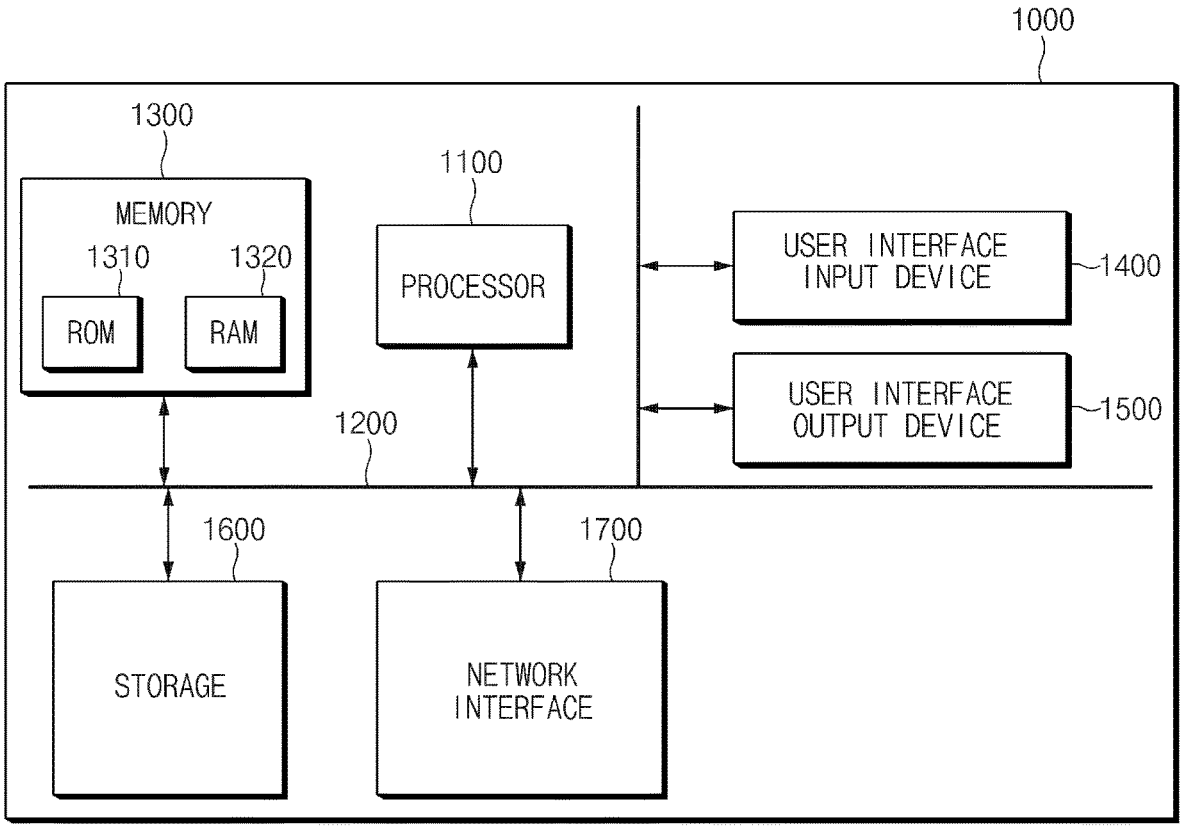
FIG. 9 is a block diagram illustrating a computer system, to which a control method of recognizing a fuel type is applied, according to an embodiment of the present disclosure.

FIG. 9 is a block diagram illustrating a computer system, to which a control method of recognizing a fuel type is applied, according to an embodiment of the present disclosure.

Referring to FIG. 9, a computing system 1000 may include at least one processor 1100, a memory 1300, a user interface input device 1400, a user interface output device 1500, a storage 1600, and a network interface 1700, which are connected with each other via a bus 1200.

The processor 1100 may be a central processing unit (CPU) or a semiconductor device for processing instructions stored in the memory 1300 and/or the storage 1600. Each of the memory 1300 and the storage 1600 may include various types of volatile or non-volatile storage media. For example, the memory 1300 may include a read only memory (ROM) and a random-access memory (RAM).

Thus, the operations of the methods or algorithms described in connection with the embodiments disclosed in the present disclosure may be directly implemented with a hardware module, a software module, or combinations thereof, executed by the processor 1100. The software module may reside on a storage medium (i.e., the memory 1300 and/or the storage 1600), such as a RAM, a flash memory, a ROM, an erasable and programmable ROM (EPROM), an electrically EPROM (EEPROM), a register, a hard disc, a removable disc, or a compact disc-ROM (CD-ROM).

In an embodiment, the storage medium may be coupled to the processor 1100. The processor 1100 may read out information from the storage medium and may write information in the storage medium. Alternatively, the storage medium may be integrated with the processor 1100. The processor and storage medium may reside in an application specific integrated circuit (ASIC). The ASIC may reside in a user terminal. Alternatively, the processor and storage medium may reside as separate components of the user terminal.

As described above, the present disclosure is applicable to various vehicles regardless of the fuel types of the vehicles as the fuel types may be exactly distinguished by using the control device for recognizing the fuel type and thus the fuel pumps may be controlled according to the fuel types.

In addition, even if errors occur in the communication signal (CAN signal) for distinguishing between the fuel types, the safe mode may be realized and thus the fuel type may be stably distinguished.

Hereinabove, although the present disclosure has been described with reference to specific embodiments and the accompanying drawings, the present disclosure is not limited thereto. The present disclosure may be variously modified and altered by those skilled in the art to which the present disclosure pertains without departing from the spirit and scope of the present disclosure claimed in the following claims.

Therefore, embodiments of the present disclosure are not intended to limit the technical spirit of the present disclosure, but provided only for the illustrative purpose. The scope of protection of the present disclosure should be construed by the attached claims, and all equivalents thereof should be construed as being included within the scope of the present disclosure.

What is claimed is:

1. A control device for recognizing a fuel type, the control device comprising:

a processor; and a non-transitory storage medium containing program instructions, execution of which by the processor causes the control device to provide functions of:

receiving a fuel type communication signal from an electronic control unit (ECU);

storing, in the non-transitory storage medium, fuel type information determined at every vehicle start-up; and determining the fuel type by using the fuel type communication signal or the fuel type information stored in the non-transitory storage medium at and/or before the vehicle start-up.

2. The control device of claim 1, wherein the processor further causes the control device to determine the fuel type by using the fuel type communication signal, if the vehicle start-up is an initial start-up.

3. The control device of claim 1, wherein the processor further causes the control device to determine the fuel type by comparing the fuel type communication signal with the fuel type information stored in the non-transitory storage medium, if the vehicle start-up is not an initial start-up.

4. The control device of claim 1, wherein the processor further causes the control device to determine the fuel type as a fuel type of the fuel type information, if the fuel type communication signal is matched with the fuel type of the fuel type information.

5. The control device of claim 1, wherein the processor further causes the control device to update the fuel type information to a fuel type of the fuel type communication signal and determine the fuel type as the fuel type of the fuel type communication signal, if the fuel type of the fuel type communication signal is not matched with a fuel type of the fuel type information.

6. The control device of claim 1, wherein the processor further causes the control device to determine whether the fuel type communication signal or the fuel type information is valid.

7. The control device of claim 6, wherein the processor further causes the control device to enter into a safe mode, if the fuel type communication signal or the fuel type information is invalid, and determine the fuel type by using a target fuel pressure value or a sensed fuel temperature value instead of the fuel type communication signal.

8. The control device of claim 7, wherein the processor further causes the control device to determine the fuel type as a gasoline type if the target fuel pressure value is equal to or more than 1 or the sensed fuel temperature value is absent.

9. The control device of claim 6, wherein the processor further causes the control device to enter into a safe mode, if the vehicle start-up is an initial start-up and if the fuel type communication signal is invalid, and determine the fuel type by using a target fuel pressure value or a sensed fuel temperature value instead of the fuel type communication signal.

10. The control device of claim 1, wherein, if the processor further causes the control device to determine the fuel type at every vehicle start-up, the non-transitory storage medium stores the determined fuel type as the fuel type information.

11. A fuel pump control system comprising:

an electronic control unit (ECU) configured to output a communication signal for vehicle control;

a processor; and a non-transitory storage medium containing program instructions that, when executed by the processor, causes the fuel pump control system to:

recognize a fuel type and to determine the fuel type of a vehicle by comparing the communication signal received from the ECU with fuel type information stored at every vehicle start-up; and control a fuel pump based on the determined fuel type.

12. The fuel pump control system of claim 11, wherein the processor further causes the fuel pump control system to:

receive a fuel type communication signal from the ECU;

store, in the non-transitory storage medium a fuel type information determined at every vehicle start-up; and determine the fuel type by using the fuel type communication signal or the fuel type information stored in the non-transitory storage medium at the vehicle start-up.

13. The fuel pump control system of claim 12, wherein the processor further causes the fuel pump control system to determine the fuel type as a fuel type based on the fuel type information, if the fuel type communication signal is matched with the fuel type of the fuel type information; and wherein the processor further causes the fuel pump control system to update the fuel type information to a fuel type of the fuel type communication signal and determine the fuel type as the fuel type of the fuel type communication signal, if the fuel type of the fuel type communication signal is not matched with the fuel type of the fuel type information.

14. A control method of recognizing a fuel type, the control method comprising:

receiving a fuel type communication signal from an electronic control unit (ECU); and determining a fuel type of a vehicle at a vehicle start-up by using the fuel type communication signal or fuel type information previously stored at every previous vehicle start-up.

15. The control method of claim 14, further comprising:

storing the determined fuel type as the fuel type information.

16. The control method of claim 14, wherein the determining of the fuel type of the vehicle includes:

determining the fuel type by using the fuel type communication signal, if the vehicle start-up is an initial start-up; and determining the fuel type by comparing the fuel type communication signal with the fuel type information, if the vehicle start-up is not the initial start-up.

17. The control method of claim 14, wherein the determining of the fuel type of the vehicle includes:

determining the fuel type as a fuel type of the fuel type information, if the fuel type communication signal is matched with the fuel type of the fuel type information; and updating the fuel type information to a fuel type of the fuel type communication signal and determining the fuel type as the fuel type of the fuel type communication signal, if the fuel type of the fuel type communication signal is not matched with the fuel type of the fuel type information.

18. The control method of claim 14, further comprising:

determining whether the fuel type communication signal or the fuel type information is normal.

19. The control method of claim 18, wherein the determining of the fuel type of the vehicle includes:

entering into a safe mode if the fuel type communication signal or the fuel type information is invalid to determine the fuel type by using a target fuel pressure value or a sensed fuel temperature value instead of the fuel type communication signal.

20. The control method of claim 19, wherein the determining of the fuel type of the vehicle further includes:

determining the fuel type as a gasoline type if the target fuel pressure value is equal to or more than 1 or the sensed fuel temperature value is absent.

* * * * *